United States Patent [19]

Thompson

[11] 3,947,793

[45] Mar. 30, 1976

[54] MULTI-LAYER TOROIDAL DEFLECTION YOKE

[75] Inventor: Ira Foy Thompson, Indianapolis, Ind.

[73] Assignee: RCA Corporation, New York, N.Y.

[22] Filed: Mar. 10, 1975

[21] Appl. No.: 556,997

[52] U.S. Cl. ..... 335/210; 335/213

[51] Int. Cl.[2] ..... H01F 7/00

[58] Field of Search ..... 335/210, 213

[56] References Cited

UNITED STATES PATENTS

| | | | |
|---|---|---|---|
| 3,801,941 | 4/1974 | Phillips | 335/213 X |
| 3,875,543 | 4/1975 | Gostyn et al. | 335/213 X |

*Primary Examiner*—G. Harris

*Attorney, Agent, or Firm*—E. M. Whitacre; Paul J. Rasmussen

[57] ABSTRACT

A multi-layer toroidal deflection yoke includes a flared ferrite core and grooved ring members respectively disposed at the large and small diameter ends of the core to determine the position of several layers of toroidally wound conductor turns which form the deflection windings. The large diameter ring member includes radially extending tabs forming conductor receiving pockets therebetween. Each pocket has a width less than the combined diameters of the generally side-by-side conductor turns wound in the pocket. Each pocket includes first and second conductor seat portions at different heights so that the first conductor turn is retained in the first seat portion by a first tab and the second seat, the second conductor turn is retained by the first conductor turn and a second tab and subsequent conductor turns are similarly retained.

7 Claims, 3 Drawing Figures

MULTI-LAYER TOROIDAL DEFLECTION YOKE

BACKGROUND OF THe INVENTION

This invention relates to a multi-layer toroidal deflection yoke including front and rear ring members for retaining conductor turns.

It is known that precision and repeatability can be achieved in winding toroidal deflection yokes for television receivers by retaining each conductor turn of a given winding distribution in grooved ring members located at the front and rear portions of the deflection yoke core. The technology making this precision winding possible has permitted deflection yoke designers to utilize specific winding distributions for providing self-converging and raster correction features in the deflection yoke itself, resulting in less complex television receiver designs.

Particularly when these precision toroidal deflection yokes are utilized with relatively large screen size picture tubes having relatively wide deflection angles such as 110°, it may be necessary to add additional conductor turns to enhance the sensitivity of the vertical deflection coils or to add additional conductor turns for forming quadrature windings to aid in converging the three beams of a color picture tube when the windings are suitably energized. To accommodate a relatively large number of conductor turns, it has been the practice in the past to wind multiple layers of turns, with the succeeding layers of conductor turns at the small diameter portion of the yoke lying above and interleaved between conductor turns of the next preceding layer. However, these turns flare outwardly towards the large diameter portion of the yoke, resulting in more spacing between conductors so specific grooves in the large diameter ring member must retain each conductor turn. As the number of conductor turns increases, the radially extending tabs defining the conductor turn retaining grooves must necessarily become thinner. Eventually a point is reached whereat the tabs are so thin that the molding thereof becomes difficult as the plastic ring member material does not flow readily into the small crevices of the mold. Even should molding be successful, the tabs are so thin that a lateral stress on the tabs such as caused by returning the conductor turn at a nonradial angle along the outside surface of the yoke may cause the tabs to bend, thereby possibly resulting in the conductor turn slipping out of its groove or the bent tab preventing the entry of another conductor turn in the next adjacent groove. Obviously it is desirable to provide an arrangement for precision placement and retention of the conductor turns.

SUMMARY OF THE INVENTION

A multi-layer toroidal deflection yoke includes a hollow flared ferrite core and first and second conductor turn retaining ring members respectively disposed at the small diameter rear portion and the large diameter front portion of the core for fixedly retaining a plurality of conductor turns toroidally wound around the core for forming a deflection winding. The second ring member includes a plurality of radially extending separated tabs, the separation between two adjacent tabs defining a conductor turn receiving pocket, the pocket width being less than the combined diameters of generally side-by-side conductor turns to be received therein. The pocket includes adjacent first and second conductor turn seat portions having different heights such that successive conductor turns disposed in the pocket are disposed laterally and vertically from each other in firm support.

A more detailed description is given in the following description and accompanying drawing of which:

DESCRIPTION OF A PREFERRED EMBODIMENT OF THE INVENTION

Figure 1:
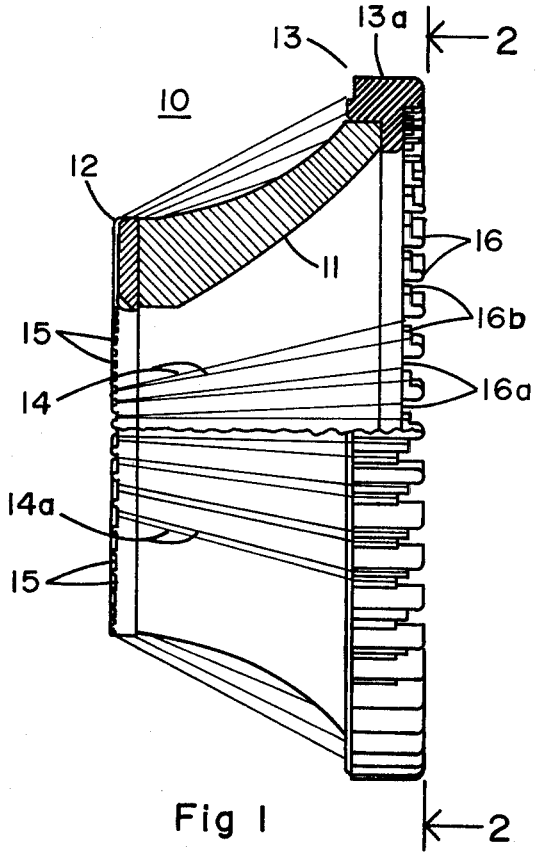
FIG. 1 is a partial cutaway view of a deflection yoke embodying the invention.

FIG. is a partial cutaway view of a deflection yoke 10 embodying the invention. A hollow flared generally cylindrical ferrite core 11 has a ring member 12 at its rear or small diameter portion and a ring member 13 at its front or large diameter portion. Ring member 12 has a plurality of radially extending grooves 15 for retaining conductor turns 14 and **14*a* in desired locations at the rear of the yoke. Active conductor turns 14 wound along the inside flare of core 11 provide the desired magnetic deflection field when suitably energized. Conductor turn portions 14*a* are the return conductors extending from the front to the rear of the yoke on the outside of core 11. Ring member 12 may be permanently fastened to core 11** by a bonding agent such as epoxy.

Front ring member 13 includes a circular shoulder portion **13*a* which forms a press fit over the front outer circumference of core 11 to fixedly retain ring member 13 in relation to core 11 and rear ring member 12. Ring member 13 includes a plurality of radially extending tabs 16 defining a plurality of conductor turn receiving pockets between each two adjacent tabs 16. The pocket includes a first seat portion 16*a* and a second seat portion 16*b* adjacent to each other but of different heights for retaining conductor turns 14.**

Figure 2:
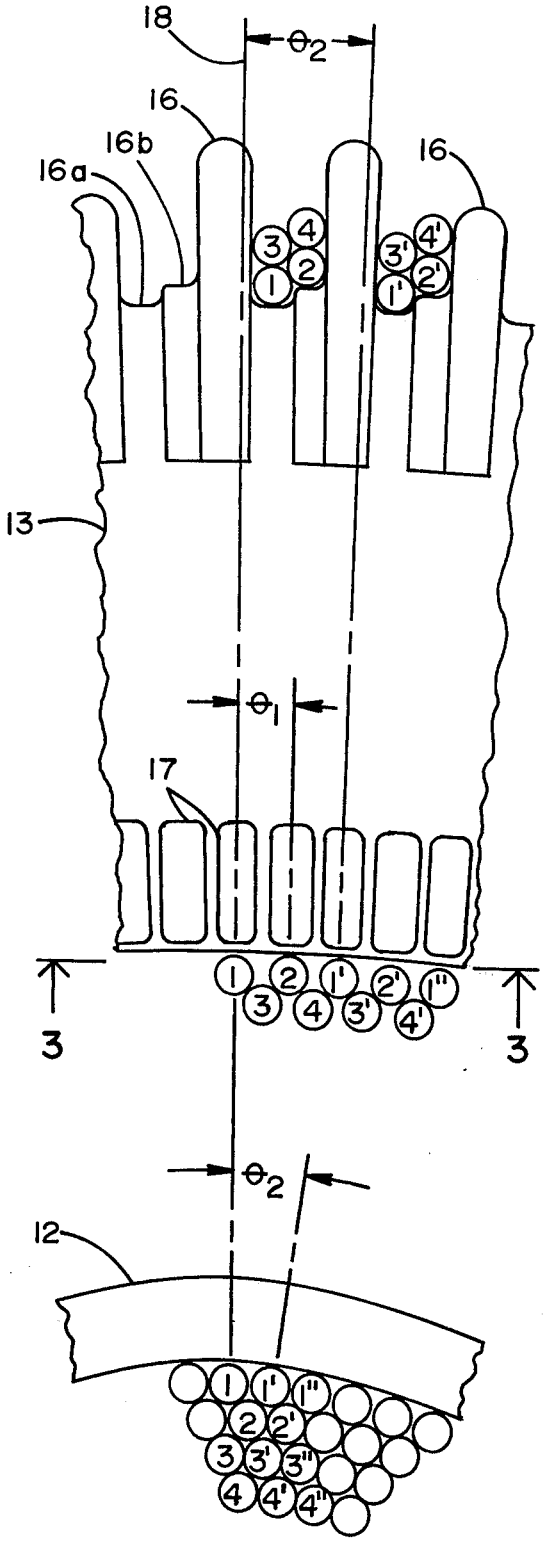
FIG. 2 is an enlarged partial front section view taken along the section lines 2—2 of FIG. 1 and showing details of conductor turn placement at the large and small diameter portions of the deflection yoke.

FIG. 2 is an enlarged partial front section view taken along the section lines 2—2 of FIG. 1 and showing details of conductor turn placement at the large and small diameter portions of the deflection yoke 10. In FIG. 2, front ring member 13 includes around its outer circumference a plurality of radially extending tabs 16. Tabs 16 are spaced apart from each other by an angular separation $\Theta_2$. The space between adjacent tabs 16 forms a pocket which includes a first seat portion **16*a* adjacent to a higher seat portion 16*b*. Seat portions 16*a* and 16*b* may have their seating surfaces molded slightly concave as illustrated to aid in the retention of conductor turns seated thereon. Along the inner circumference of ring member 13 are a plurality of grooves 17 which are molded into the ring member to aid in the positioning and retaining of the conductor turns. It is noted that there are two grooves 17 associated with each pocket defined by tabs 16. Adjacent grooves 17 are separated by an angle $\theta_1$, which is one-half of $\theta_2$. End views of conductors represented by numbered circles are illustrated adjacent front ring member 13 and rear ring member 12.**

The grooves 15 of rear ring member 12 are not visible in the FIG. 2 view as they are behind the ring member 12 as viewed in FIG. 2. A plurality of conductor turns 1, 1′, 1″, etc. form a first layer of conductor turns at the rear of the deflection yoke adjacent the inner circumference of rear ring member 12. The return conductors at the rear of the yoke in FIG. 2 are not illustrated to simplify the drawing. Similarly, conductors 2, 2′, 3, 3′, and 4 and 4′ find respective second, third and fourth conductor layers at the rear or small diameter portion of the yoke. It is noted that at the rear of the yoke the second layer of conductors is retained by their being interleaved between conductors of the first layer; a similar arrangement is used to position and retain the conductor turns of the third and fourth layers.

A reference line 18 shows the alignment relationship of the parts of the front and rear ring members and the respective conductor turns. Conductor turn 1 is brought forward from rear ring member 12 to lie in a specific groove 17, which is bisected by reference line 18, of front ring member 13 and from there to lie in a seat portion **16*a* between the tabs 16. From there the conductor is returned along the outside of the yoke to form a conductor turn designated by 1′. When the second layer is wound, a number 2 conductor illustrated interleaved between conductors 1 and 1′ at the rear of the yoke is wound forward to lie in another groove 17 of front ring member 13 to seat portion 16*b* of ring member 13 and from there is retruned to form a conductor turn to prime. A conductor number 3 of a third conductor layer is wound forward to be retained by conductors 1 and 2 on the inner circumference of ring member 13 to be retained at the outer circumference thereof by tab members 16 and conductor 2. A conductor 4 from the fourth layer at the small diameter portion of the yoke is similarly retained by the front ring member 13** as illustrated.

It is noted that the distance between surfaces of adjacent tabs 16 is less than twice the diameter of the conductor wire. This dimensioning together with the offset height of seat portion **16*a* relative to seat portion 16*b* allows the conductors to be spaced from each other laterally and vertically and firmly retained by the tabs 16 and adjacent conductors as additional layers are wound. Thus, there is precision placement of each of the conductors from each of the layers because only two tabs 16 are required to support four conductors. Tabs 16 may be made relatively wide and hence do not present the molding and bending problem described above. At the same time, each conductor has precision spacing and firm retention as illustrated in FIG. 2.** This precision spacing and firm retention permits an exact winding distribution to be achieved even with four or more layers of conductors.

Figure 3:
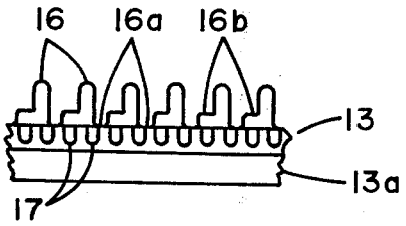
FIG. 3 is a partial sectional view taken along section lines 3—3 of FIG. 2 and showing details of the large diameter ring member of the deflection yoke.

FIG. 3 is a partial sectional view taken along section lines 3—3 of FIG. 2 and shows the side view details of front ring member 13. In the illustrated embodiment the angle $\theta_2$ defining the spacing between adjacent conductors at the small diameter portion of the deflection yoke is twice as large as $\theta_1$ defining the spacing between grooves 17 at the front portion of the deflection yoke. Thus, for example, if there were 328 conductor receiving grooves 17 in front ring 13, there would be half of that or 164 conductor turns in the first layer at the rear portion of the yoke if all of the spaces were filled. With the described arrangement, the tightly packaged layered conductors at the rear of the yoke are flared outwardly in a less dense spatial distribution but are nonetheless held in precision alignment at the front of the yoke and are firmly retained by the front ring member arrangement according to the invention.

What is claimed is:

1. A multi-layer toroidal deflection yoke comprising:

a hollow flared ferrite core;

first and second conductor turn retaining ring members respectively disposed at the small diameter rear portion and the large diameter front portion of said core for fixedly retaining a plurality of conductor turns toroidally wound around said core for forming a deflection winding;

said second ring member including a plurality of radially extending separated tabs, the separation between two adjacent tabs defining a conductor turn receiving pocket, said pocket width being less than the combined diameters of generally side-by-side conductor turns to be received therein, said pocket including adjacent first and second conductor turn seat portions having different heights such that successive conductor turns disposed in said pocket are disposed laterally and vertically from each other.

2. A multi-layer toroidal deflection yoke according to claim 1 wherein said second ring member includes a plurality of radially extending grooves separated from said tabs and pockets and aligned relative to said tabs and pockets for retaining said conductor turns laterally prior to their disposition in said pockets.

3. A multi-layer toroidal deflection yoke according to claim 1 wherein the edges of said tabs are rounded for guiding said conductor turns into said pockets.

4. A multi-layer toroidal deflection yoke according to claim 2 wherein one conductor turn from each of a plurality of conductor turn layers at the small diameter portion of said yoke is disposed in one of said pockets.

5. A multi-layer toroidal deflection yoke according to claim 4 wherein two of said grooves in said second ring member are associated with each of said pockets.

6. A multi-layer toroidal deflection yoke according to claim 5 wherein said first ring member includes one-half the number of radially extending grooves as said second ring member.

7. A multi-layer toroidal deflection yoke according to claim 6 wherein said tabs and pockets are formed on the outer circumference of said second ring member and said grooves are formed adjacent the inner circumference of said second ring member.

* * * * *